US009109430B2

(12) United States Patent
Ibanez

(10) Patent No.: US 9,109,430 B2
(45) Date of Patent: Aug. 18, 2015

(54) BLOW-OUT PREVENTER, AND OIL SPILL RECOVERY MANAGEMENT SYSTEM

(75) Inventor: Ruth C. Ibanez, Jackson Heights, NY (US)

(73) Assignee: Ruth C. Ibanez NY (US)

( * ) Notice: Subject to any disclaimer, the term of this patent is extended or adjusted under 35 U.S.C. 154(b) by 65 days.

(21) Appl. No.: 13/171,578

(22) Filed: Jun. 29, 2011

(65) Prior Publication Data

US 2012/0055680 A1 Mar. 8, 2012

Related U.S. Application Data

(60) Provisional application No. 61/360,105, filed on Jun. 30, 2010, provisional application No. 61/375,486, filed on Aug. 20, 2010, provisional application No. 61/407,620, filed on Oct. 28, 2010.

(51) Int. Cl.
*E21B 34/06* (2006.01)
*E21B 33/06* (2006.01)
*E21B 43/01* (2006.01)

(52) U.S. Cl.
CPC ..... *E21B 43/0122* (2013.01)

(58) Field of Classification Search
CPC ..... E21B 43/0122
USPC ..... 166/373, 85.4, 81.1, 84.3, 363, 364; 251/251, 1.1, 1.3; 137/312, 313, 236.1
See application file for complete search history.

(56) References Cited

U.S. PATENT DOCUMENTS 1,520,377 A * 12/1924 Washburn ..... 137/498
1,852,716 A * 4/1932 Grinnell ..... 417/54
2,846,178 A * 8/1958 Minor ..... 251/1.2
3,084,898 A * 4/1963 Miller ..... 251/1.1
3,548,605 A * 12/1970 Armistead et al. ..... 405/60
4,273,472 A * 6/1981 Piazza et al. ..... 405/211
4,906,137 A * 3/1990 Maloberti et al. ..... 405/224.3
5,060,985 A * 10/1991 Seaton ..... 285/123.4
5,181,746 A * 1/1993 Hessel et al. ..... 285/3
5,368,670 A * 11/1994 Kauffman ..... 156/171
6,913,079 B2 * 7/2005 Tubel ..... 166/250.01
7,232,354 B2 * 6/2007 Olson et al. ..... 441/7
7,565,932 B2 * 7/2009 Lawson ..... 166/344
7,578,350 B2 * 8/2009 Cooper et al. ..... 166/368
7,845,404 B2 * 12/2010 McStay et al. ..... 166/250.01
8,141,643 B2 * 3/2012 Fowkes ..... 166/338
2007/0022935 A1 * 2/2007 Griffith et al. ..... 114/312
2011/0274496 A1 * 11/2011 Dvorak ..... 405/64
2012/0260839 A1 * 10/2012 Maher et al. ..... 114/257
2012/0267115 A1 * 10/2012 Brown et al. ..... 166/336

* cited by examiner

*Primary Examiner* — Jennifer H Gay
*Assistant Examiner* — George Gray
(74) *Attorney, Agent, or Firm* — Ursula B. Day, Esq.; Stefan Knirr, Esq.

(57) ABSTRACT

An apparatus for containing and controlling the flow of hydrocarbons from a bore well or other earth formation includes a housing enclosing a receiving and distribution chamber, receiving and distribution chamber is in fluid communication with and sealably connected to a top vertical tubular member and a bottom vertical tubular member, wherein the top and bottom tubular members extend from the receiving and distribution chamber to the exterior of said housing. The apparatus further includes a cone aperture adapted to prevent or allow the flow of liquid into the top tubular member, at least one outlet passage between the receiving and distribution chamber and the exterior of the housing, valve means adapted to permit or prevent the flow of liquid through at least one of said outlet passages, and pump devices adapted to facilitate the flow of hydrocarbons through at least one of said outlet passages.

20 Claims, 16 Drawing Sheets

BLOW-OUT PREVENTER, AND OIL SPILL RECOVERY MANAGEMENT SYSTEM

CROSS-REFERENCES TO RELATED APPLICATIONS

This application claims the benefit of prior filed provisional application, Appl. No. 61/360,105, filed Jun. 30, 2010, pursuant to 35 U.S.C. 119(e), the subject matter of which is incorporated herein by reference.

This application claims the benefit of prior filed provisional application, Appl. No. 61/375,486, filed Aug. 20, 2010, pursuant to 35 U.S.C. 119(e), the subject matter of which is incorporated herein by reference.

This application claims the benefit of prior filed provisional application, Appl. No. 61/407,620, filed Oct. 28, 2010, pursuant to 35 U.S.C. 119(e), the subject matter of which is incorporated herein by reference.

BACKGROUND OF THE INVENTION

The present invention relates to the field of oil and gas drilling and in particular to apparatuses for the containment and control of the flow of hydrocarbons from oil and gas wells.

An inherent risk in oil and gas exploration is the unintended release of oil or gas into the environment. A common cause for these releases are sudden pressure variations during the drilling process (so called kicks), usually caused by influx of formation fluids into the well bore. If the formation fluids are allowed to reach the surface, well tools and other drilling material may be blown out of the wellbore. These blowouts may result in destruction of the drilling equipment and injury or death to rig personnel. The main tool to prevent spills from these pressure variations used today are blowout preventers which essentially represent sealing devices to seal off the wellbore until active measures can be taken to control the kick. However, even with blowout preventers in place, the risk of oil spills remains. Spills can still occur due to material failure of the blowout preventer resulting from excessive pressure or accidental disruption of conducting components such as riser pipes, as well as catastrophic destruction of drilling platforms. Once a spill has occurred, measures must be taken to contain it. In previously occurring oil spills those measures have included the permanent sealing of the wellbore with filling material, and capturing the spilling oil by temporary capping of the well.

It has been recognized that known blowout preventer systems are susceptible to leaks due to material failure under high pressure. Especially in deep sea oil drilling, blowout preventers are subjected to enormous stress from external hydrostatic pressure of seawater and formation fluid pressure of the wellbore. Blowout preventers commonly used today consist of many interconnected parts with gaskets meant to seal leakage of formation fluids through the sites of interconnection. An example for a typical blowout preventer used in oil exploration is U.S. Pat. No. 7,300,033. The high stress exerted on the interconnecting spaces and gaskets makes these elements sites for potential leaks. In addition, current blowout preventer systems lack the ability to detect the build up of gas at the wellbore and relay this information to drilling personnel. Further, it has been generally recognized that current systems for emergency containment and recovery of oil spills are inadequate. An example for such a system is the apparatus used during the oil spill from the Moncado oil well in the Gulf of Mexico in 2010. The apparatus used in the Moncado oil spill essentially represents a dome designed to enclose the ruptured oil pipe. At its top this dome can be connected to a riser pipe. After placement of the device over the ruptured pipe of the Moncado well, hydrates formed due to low temperature, and accumulated in the upper region of the dome, preventing oil flow from the device into the riser pipe. Since the hydrates are lighter than water they also caused the device to become buoyant and float upwards. The attempt to contain the Moncado well and recover the spilling oil using the containment structure eventually failed. Further, emergency containment systems currently in use do not have the ability to regulate oil flow in real time but can only operate on an on or off basis.

It would therefore be desirable and advantageous to provide an improved blow-out preventer and oil spill recovery management system to obviate prior shortcomings of other systems and to provide a system in which stress on the device from formation fluid pressure is minimized, which is able to detect gas build up during drilling operations at the wellbore, and which is better adapted to respond to emergency oil spills.

SUMMARY OF THE INVENTION

In some embodiments the invention relates to an apparatus for containing and controlling the flow of hydrocarbons from a bore well or other earth formation, comprising:

An apparatus for containing and controlling the flow of hydrocarbons from a wellbore or other earth formation, comprising:

- a housing enclosing a receiving and distribution chamber, said receiving and distribution chamber in fluid communication with and sealably connected to a top vertical tubular member and a bottom vertical tubular member, said top and bottom tubular members extending from said receiving and distribution chamber to the exterior of said housing,
- said top vertical tubular member having an inner tubular member comprising means for moving said inner tubular member along the axis of said top vertical tubular member, said inner tubular member adapted upon movement to sealably connect or disconnect, said bottom vertical tubular member to said top vertical tubular member,
- a cone aperture adapted to prevent or allow the flow of liquid into said top tubular member,
- at least one outlet passage between said receiving and distribution chamber and the exterior of said housing,
- valve means adapted to permit or prevent the flow of liquid through at least one of said outlet passages and,
- pump means adapted to facilitate the flow of hydrocarbons through at least one of said outlet passages.

In other embodiments the invention relates to an apparatus for containing and controlling the flow of hydrocarbons from a bore well or other earth formation, comprising:

- a housing enclosing a receiving and distribution chamber, said housing comprising at least two layers, said layers having a space in between them, said receiving and distribution chamber in fluid communication with and sealably connected to a top vertical tubular member and a bottom vertical tubular member, said top and bottom tubular members extending from said receiving and distribution chamber to the exterior of said housing,
- said top vertical tubular member having an inner tubular member comprising means for moving said inner tubular member along the axis of said top vertical tubular member, said inner tubular member adapted upon movement to sealably connect or disconnect, said bottom vertical tubular member to said top vertical tubular member, a cone aperture adapted to prevent or allow the flow of liquid into said top tubular member, at least one outlet passage between said receiving and distribution chamber and the exterior of said housing, valve means adapted to permit or prevent the flow of liquid through at least one of said outlet passages and, pump means adapted to facilitate the flow of hydrocarbons through at least one of said outlet passages.

In some embodiments the invention relates to a method for containing and controlling the flow of hydrocarbons from a well bore or other earth formation using an apparatus comprising a housing enclosing a receiving and distribution chamber, said housing comprising at least two layers, said layers having a space in between them, said receiving and distribution chamber in fluid communication with and sealably connected to a top vertical tubular member and a bottom vertical tubular member, said top and bottom tubular members extending from said receiving and distribution chamber to the exterior of said housing, said top tubular member having an inner tubular member comprising means for moving said inner tubular member along the axis of said top vertical tubular member, said inner tubular member adapted upon movement to sealably connect or disconnect, said bottom vertical tubular member to said top vertical tubular member, a cone aperture adapted to prevent or allow the flow of liquid into said top tubular member, at least one outlet passage between said receiving and distribution chamber and the exterior of said housing, valve means adapted to permit or prevent the flow of liquid through at least one of said outlet passages and, pump means adapted to facilitate the flow of hydrocarbons through at least one of said outlet passages the method comprising bringing said apparatus in contact with a well bore to allow hydrocarbons to enter said receiving and distribution chamber through said bottom vertical tubular member.

The present invention resolves prior art problems by diverting and distributing oil flow entering the device evenly towards outlet passages and by relieving excess pressure through blowout relieve vents, thereby minimizing the stress exerted on the device from formation fluid pressure. Further, the system solves the problem of hydrate build up and other complications that may be related to temperature encountered in prior art emergency oil spill recovery systems by providing insulation of the device to maintain a standard temperature of pressure. In addition the system provides features that allow for real time management of oil flow once the system is deployed. Further, the system provides sensors for detecting gas build up at the wellbore and means to relay this information to drilling personnel, and therefore allows early detection of a possible kick in the wellbore.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 7A is a detail view of the bit of the system shown in FIG. 7

FIG. 8A is a detail view of the drill bit shown in FIG. 8

FIG. 12 B is a cross sectional view taken on line B-B of FIG. 12 A.

DETAILED DESCRIPTION OF PREFERRED EMBODIMENTS

Figures 1, 1A:
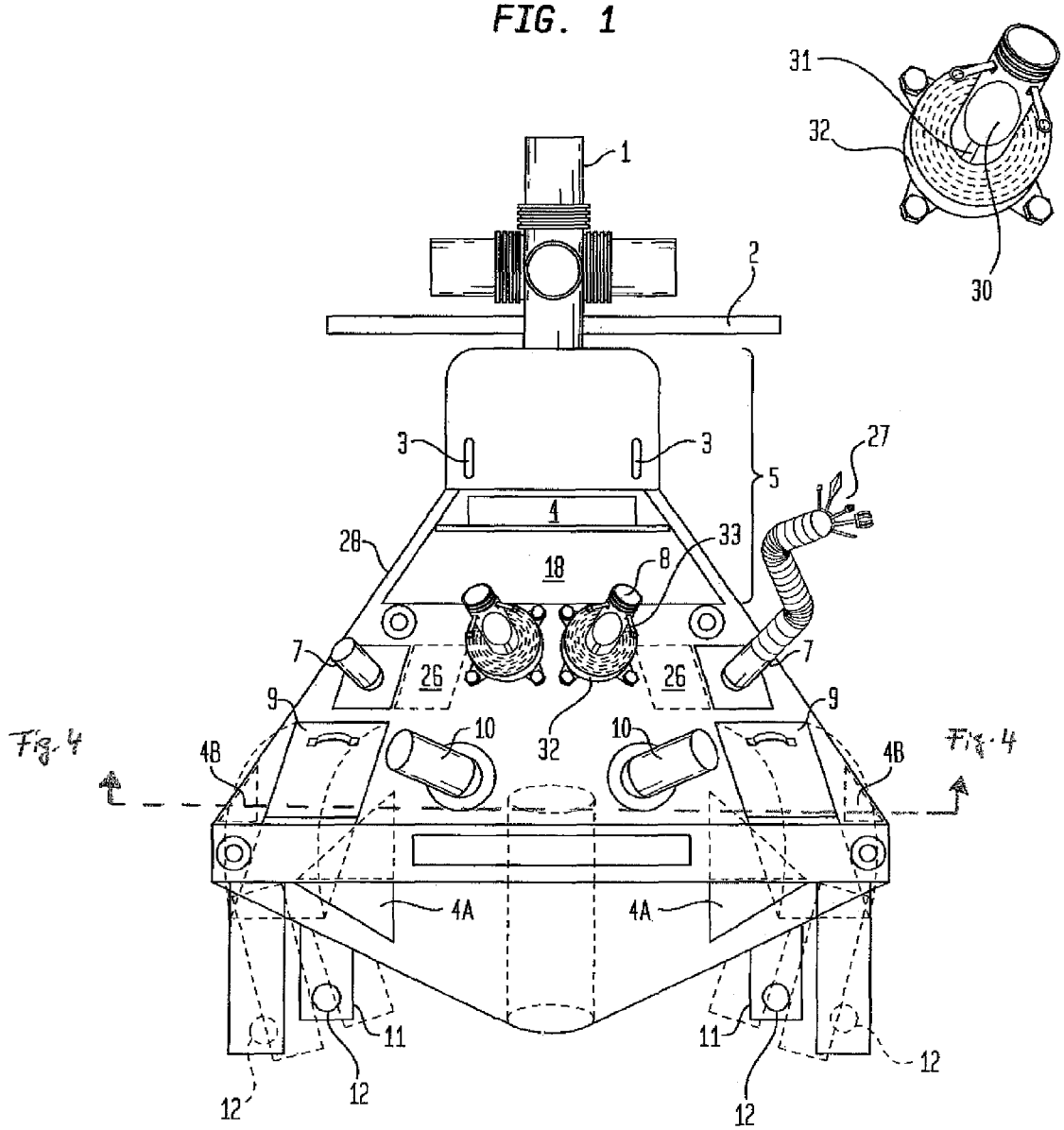
FIG. 1 is a perspective view of the system in accordance with one embodiment of the invention.
FIG. 1A is a perspective view of a hose deployment set including buoy, coiled hose canister, clamps and air supply for buoy, in accordance with one embodiment of the invention.

Throughout all the Figures, same or corresponding elements are generally indicated by same reference numerals.

Figure 2:
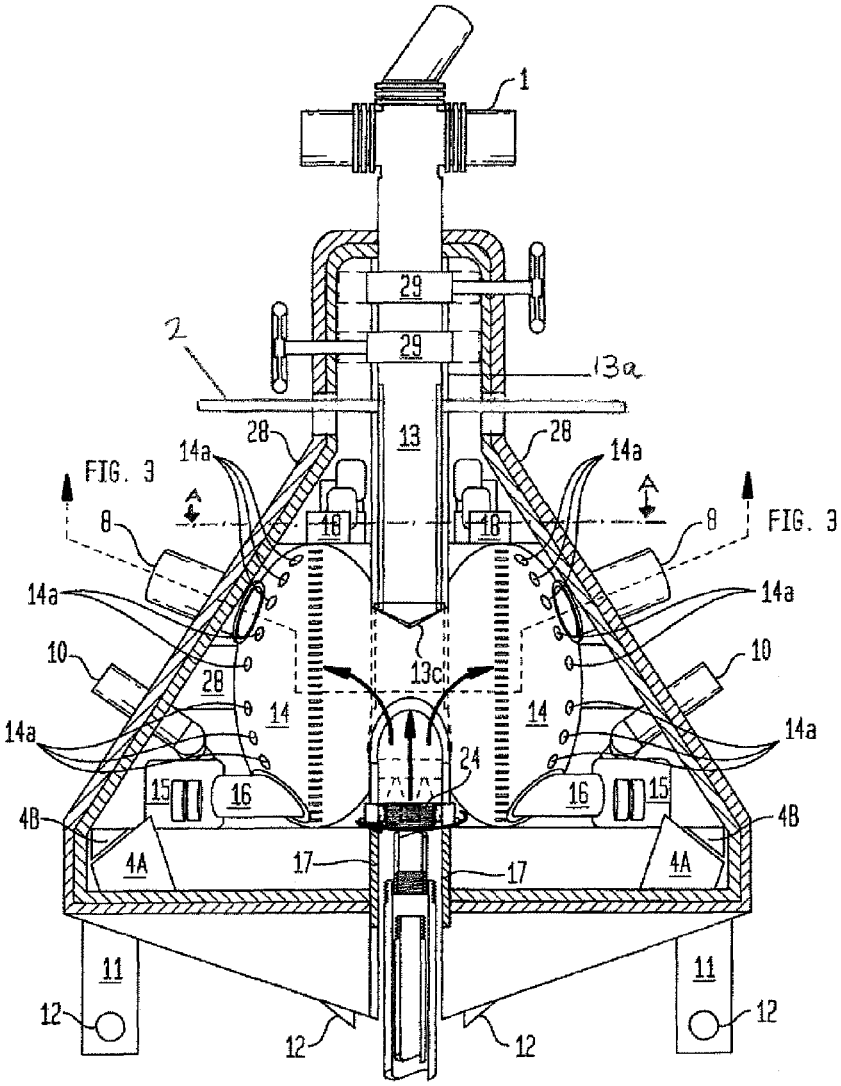
FIG. 2 is a vertical section view of the system in accordance with one embodiment of the invention.
Figure 2A:
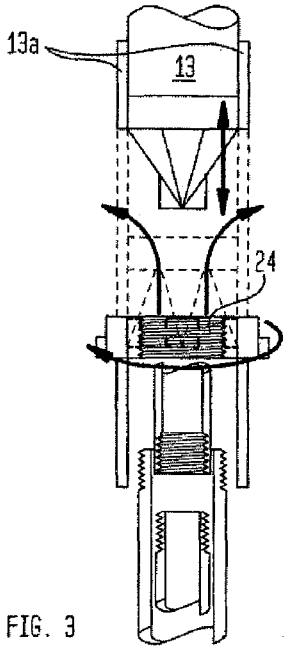
FIG. 2A is a vertical section view of the core pipe with inner sleeve pipe, cone aperture and handle bar in accordance with one embodiment of the invention.

Turning now to the drawing, and in particular to FIG. 2, there is shown a vertical section view of the Cap and Tap system according to an embodiment of the present invention with the housing (28) enclosing the receiving and distribution chamber (14) with sensors for fluid level, volume, pressure, escaped gas meter and analyzer (14*a*). On its top the receiving and distribution chamber (14) is connected to the core pipe (13*a*) that leads to the main viaduct (1). The core pipe contains an inner sleeve pipe (13) and has a cone aperture (13*c*) and a handle bar (2). On the bottom, the receiving and distribution chamber (14) is connected to the pipe threshold (17).

Hydraulic pump managed ducts (16) lead from the receiving and distribution chamber (14) to the hydraulic pump platform (15). Hydraulic pump managed output pipes (10) lead from the hydraulic pump platform to the exterior of the housing (28). Volume pressure blowout relief vents (8) lead from the receiving and distribution chamber to the exterior of the housing.

Figure 11:
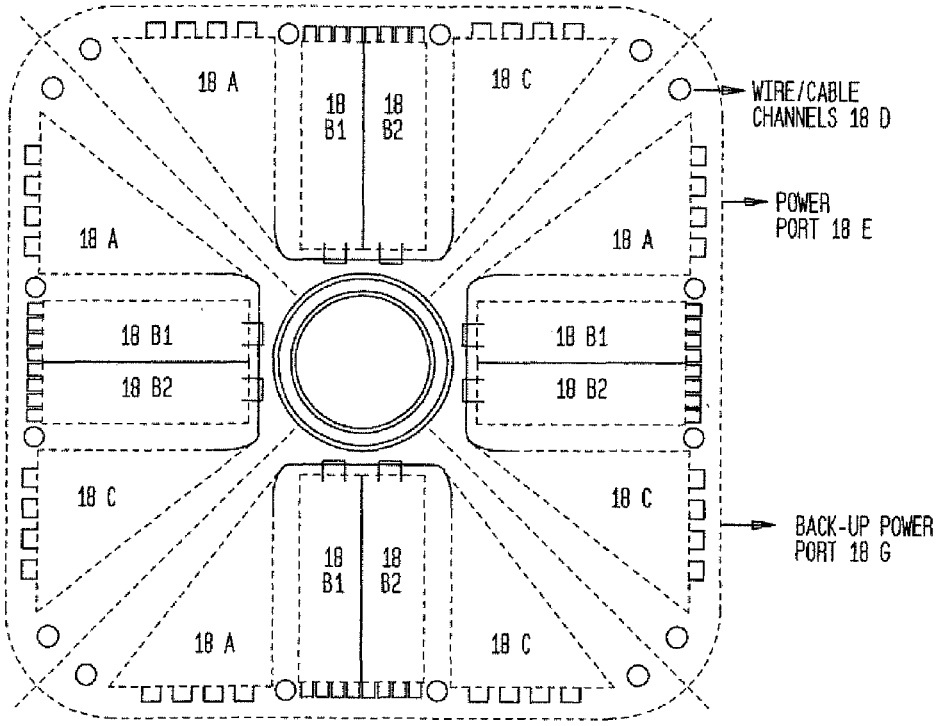
FIG. 11 is a cross sectional view of the embodiment of the device according to the invention shown in FIG. 2 taken on line A-A.
Figure 12B:
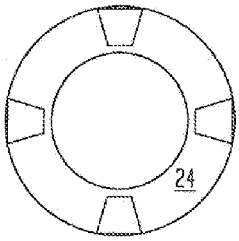
FIG. 12 A is a detailed cross sectional view of the embodiment of FIG. 1
Figure 12A:
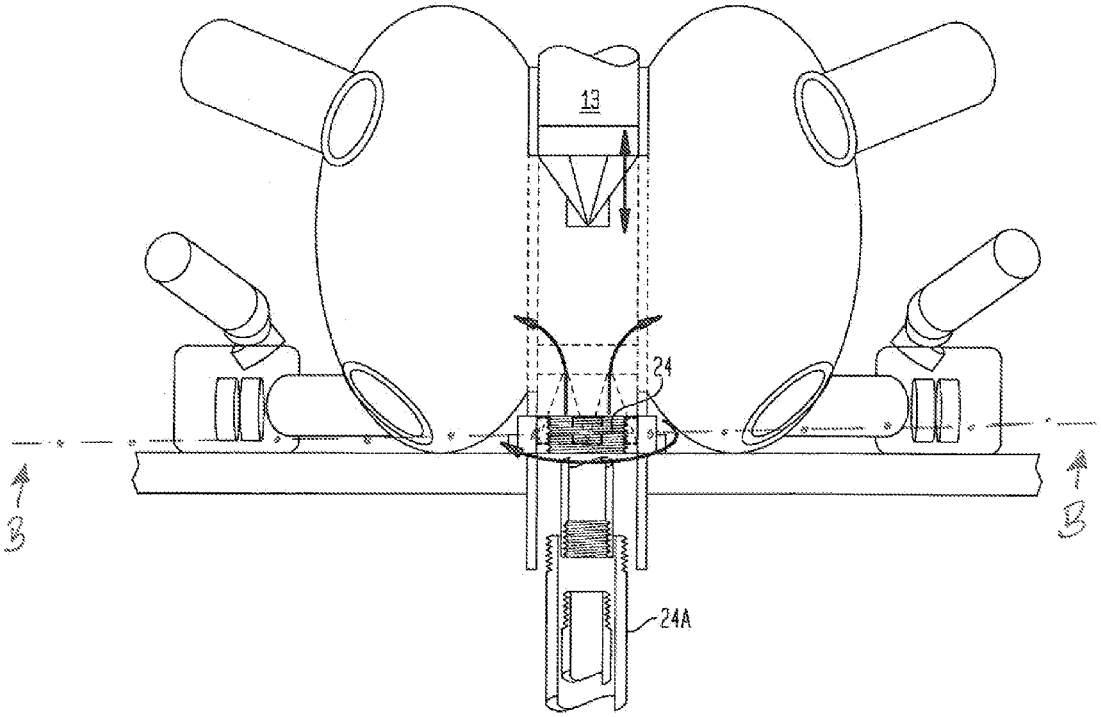

In the embodiment of the invention depicted in FIG. 2 the position of the inner sleeve pipe (13*b*) can be changed by moving it along the axis of the core pipe (13*a*). By moving the inner sleeve pipe (13*b*), operation of the invention can be changed between two alternative modes. When the sleeve pipe is in the up-position (as shown in FIG. 2), the cone aperture (13*c*) is in the closed configuration, preventing oil flow into the core pipe. In this instance, incoming oil enters the receiving and distribution chamber (14) and is distributed evenly within the chamber by the cone aperture. The oil is distributed from the receiving and distribution chamber (14) through the hydraulic pump managed ducts (16) and eventually to the output pipes (10). The sensors (14*a*) of the receiving and distribution chamber (14) are connected to a regulatory circuit (18) that in turn is connected to actuators which in turn are mechanically connected to valves adapted to permit or prevent flow of oil through the blowout relief vents. In case the pressure in the receiving and distribution chamber reaches a preset value a signal is distributed by the sensors (14*a*), to the regulatory circuit (18) which in turn activates the actuators to open the valves of the blowout relief vents to relief pressure. FIG. 11 is a cross sectional view taken along the line A-A of FIG. 2 and shows a more detailed view of the regulatory circuit 18 showing individual components 18A-G of the regulatory circuit 18. The regulatory circuit 18 can include means, for example schematically represented by reference numeral 18A for transmitting the presence of gas detected by the sensors 14*a*.

To operate the invention in the alternative mode the sleeve pipe is moved downward until it reaches the drill collar. Upon downward movement of the inner sleeve the cone aperture opens and remains in open configuration. Ideally, the inner sleeve pipe has an inner diameter relative to the outer diameter of the pipe threshold (17) that allows for a sealing engagement when the sleeve pipe is moved over the pipe threshold (17). In this instance oil is not allowed to enter the receiving and distribution chamber (14) but is directed to the main aqueduct (1). The Sleeve pipe can be moved manually with the handle bars. In particular, the handle bars are useful to overcome unforeseen obstructions such as mud or rocks or water log or corrosion.

The embodiment shown in FIG. 2 also includes means that assist in positioning the device relative to a target area e.g. a well bore. Lights (4A) and camera (4B) are positioned preferably at the lower part of the device. Centering sensors and cameras (12) are positioned in close proximity to the drill collar to aid in centering the device on the ruptured pipe. Camera and centering sensors (12) are connected to a control circuit to allow for calculation of position of the drill collar with respect to the ruptured pipe. The embodiment may also include anchoring means (11) to anchor the device to the ground once deployment is complete.

Figure 8:
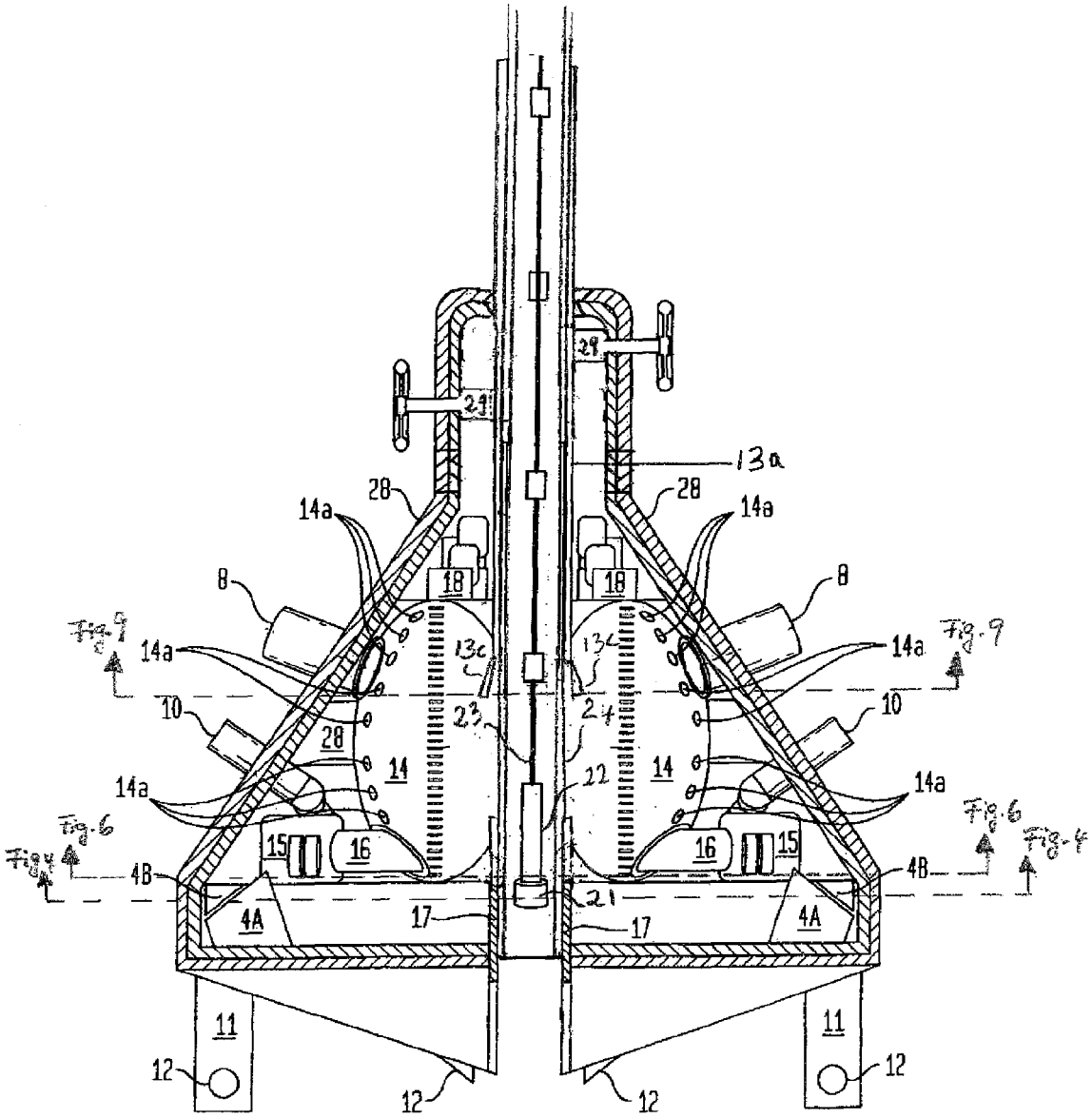
FIG. 8 is a vertical section view of the system in accordance with one embodiment of the invention.

Another embodiment of the invention is shown in FIG. 8. This embodiment comprises a retractable conduit pipe (24) to allow use of the invention in regular drilling operations. The retractable conduit pipe of the embodiment in FIG. 8 replaces the inner sleeve pipe of the embodiment shown in FIG. 2. During regular drilling operations the conduit pipe (24) passes through the core pipe and the pipe threshold into the wellbore. The drill collar (22), drill string (23) and drill bit (21) are positioned within the conduit pipe (24). During regular drilling operations the blowout relief vents (8) and the Hydraulic pump managed ducts are in closed position and not in use. The embodiment shown in FIG. 8 also comprises sensor means (14*a*) for detecting and measuring gas leakage in the wellbore.

Figure 13:
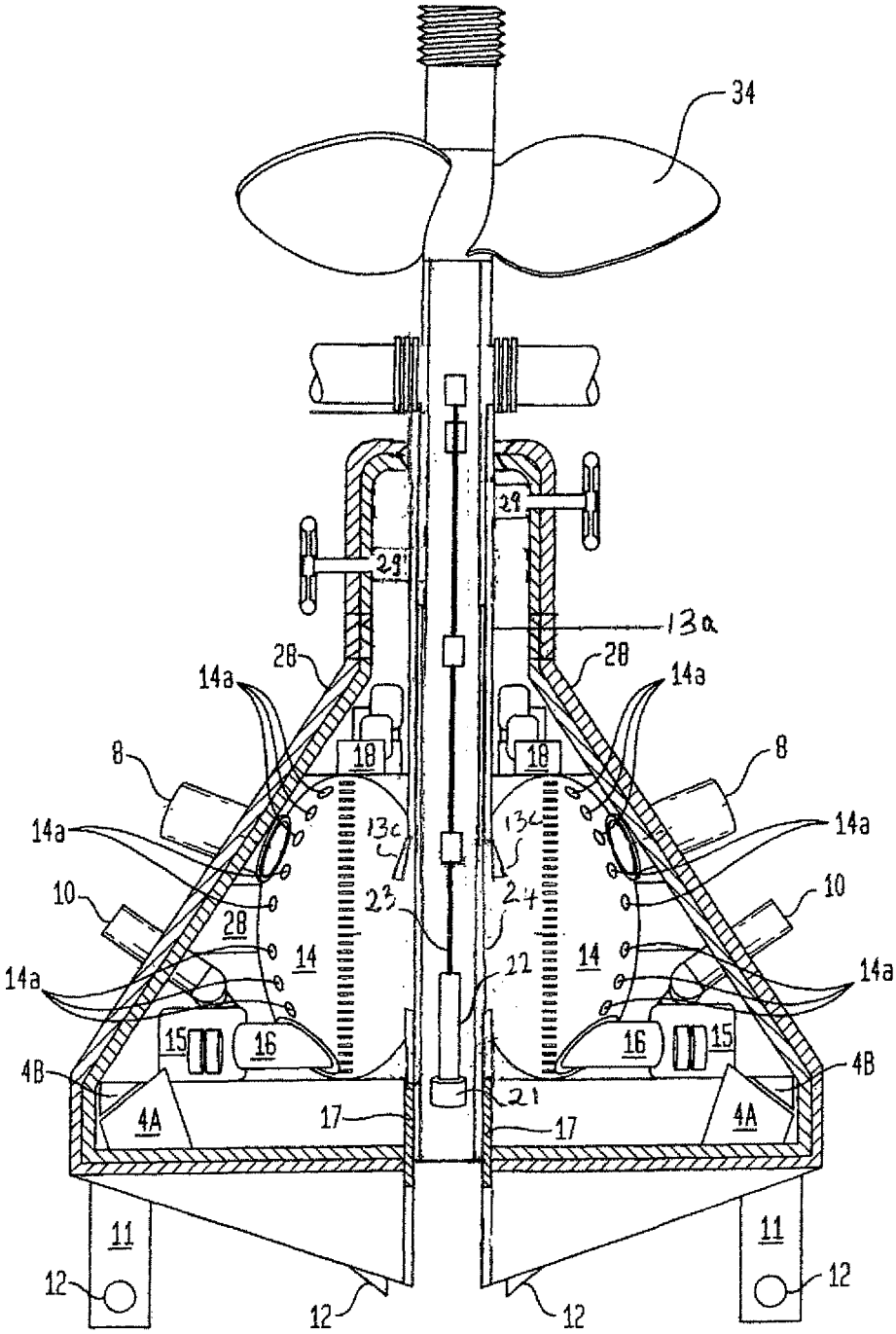
FIG. 13 shows the embodiment of FIG. 8 with propeller as propulsion means.
Figure 14:
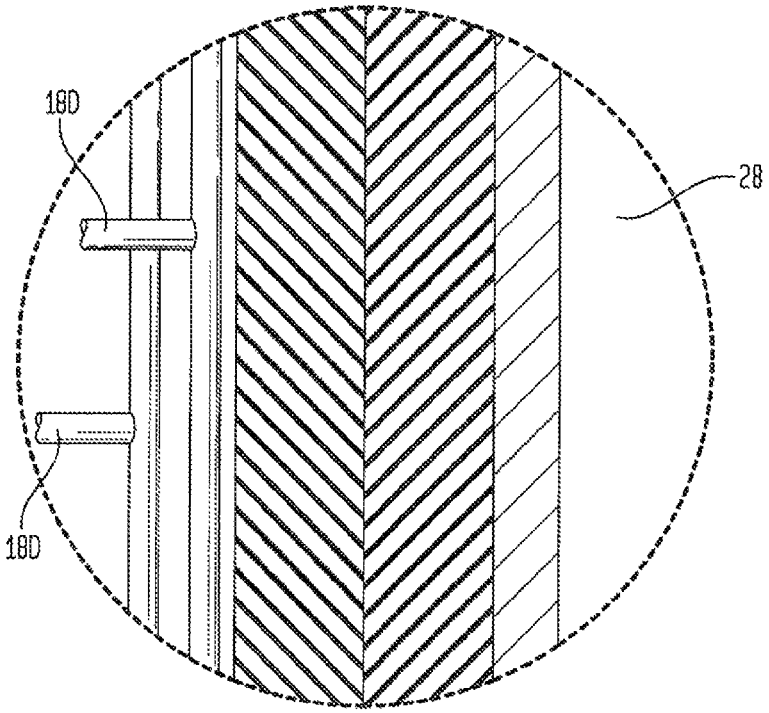
FIG. 14 is an enlargement of the encircled region of the embodiment shown in FIG. 13

FIG. 1 Is a perspective view of the system in accordance with one embodiment of the invention. As shown in FIG. 1 one advantageous embodiment may include a hose deployment set for one or more output pipes and/or relief vents. The deployment set is shown in more detail in FIG. 1A. Each set comprises a hose or other conducting means (32), an inflatable floating device (30), a source of compressed air (31) for the inflatable floating device, and clamping means (33) to connect to receiving storage facilities. The hose terminal that is proximal to the apparatus is connected to the output pipes or relief vents whereas the distal terminal of the hose is attached to the inflatable floating device, source of compressed air and clamps. Robotic arms (7) are attached to the outside of the housing and include a tool hold (27) with tools that can be used to replace and/or repair components of the device. A sliding door (26) gives access to the robotic arm chamber. Embodiments of the invention that are used offshore, may also include propulsion means for changing the position of the device relative to a target area. Such an embodiment is shown in FIG. 13 in which the propulsion means is constructed as propeller (34). Referring to FIG. 1 again, reference numeral 4 indicates a compartment in which lights cameras, sensors and power lines can be accommodated. Reference numeral 5 indicates the area that includes the compartment 4 and the regulatory circuit 18. The embodiment shown in FIG. 1 also includes doors 9 providing access to the robotic arm.

Figure 10:
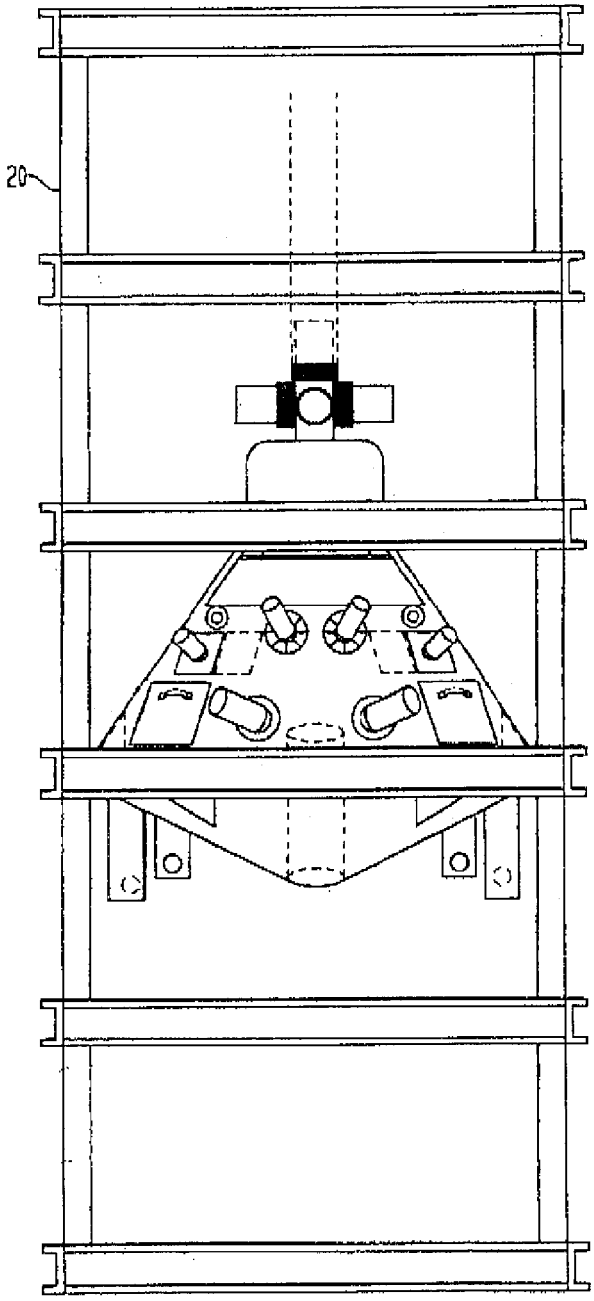
FIG. 10 is an elevational view of the system in deployment mode in accordance with one embodiment of the invention.

FIG. 10 shows an example of a method to deploy an embodiment of the invention. A scaffold (20) as shown in FIG. 10 may be placed over the target site e.g. a ruptured pipe. The apparatus is then lowered into the scaffold towards the ruptured pipe. Eyes for cable hooks (3) (see FIG. 1) may be used to attach means for suspending the apparatus. Cameras, lights and pipe centering sensors are used to guide the apparatus to the ruptured pipe. Once the ruptured pipe has been encapsulated by the pipe threshold, anchor means are activated to anchor the apparatus to the ground. A person with skill in the art will appreciate other methods to bring the apparatus into contact with a target site such as a ruptured pipe. For example, the apparatus may be lowered to the target site without the help of a scaffold depending on conditions such as water drift, wind, etc at the site of deployment. In case no scaffold is used, the apparatus may be lowered to the ocean floor manually or with the assistance microcontrollers as an independent submersible unit or vehicle.

Figure 2B:
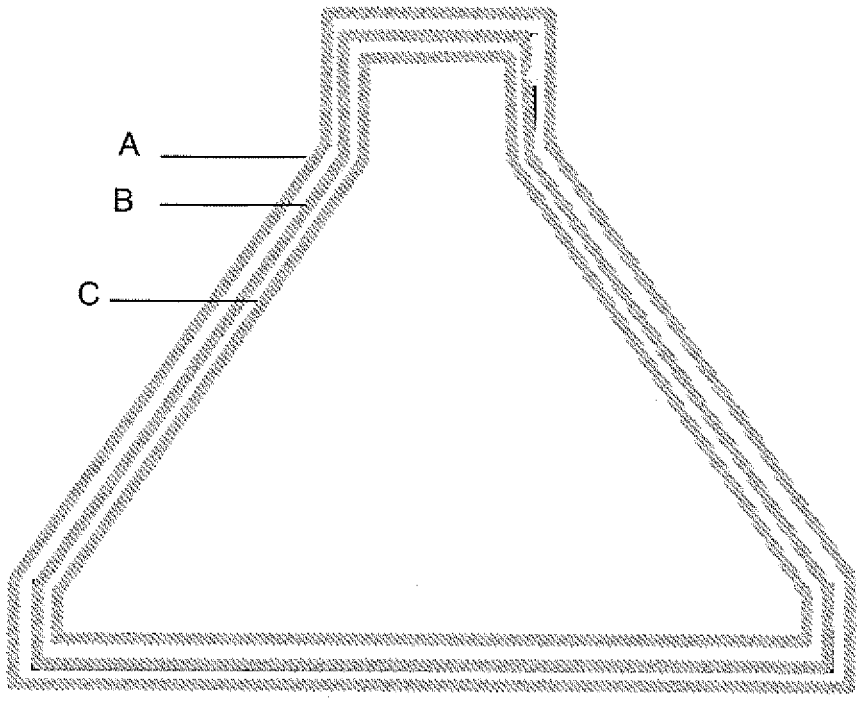
FIG. 2B is a schematic cross sectional view of the walling of another embodiment of the invention
Figure 2C:
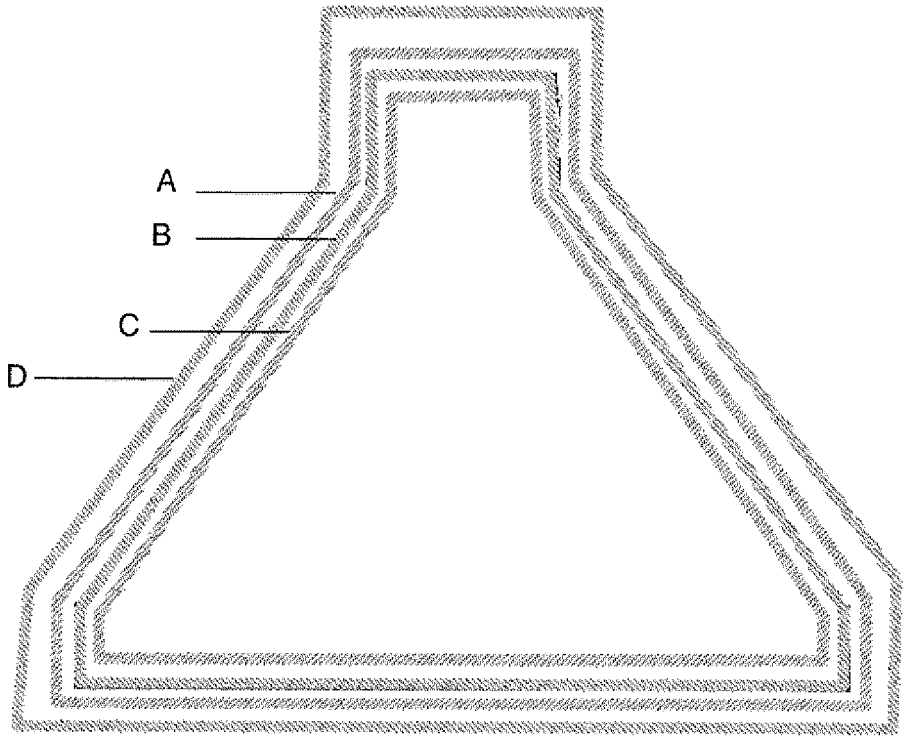
FIG. 2C is a schematic cross sectional view of the wailing of another embodiment of the invention.

The housing of the system can be designed using any material or arrangement of components which are commonly used in the art to achieve maintenance of structural integrity under conditions commonly encountered during oil exploration. A preferred material for the housing is solid-state stainless steel. The housing can comprise several layers. In another embodiment shown in FIG. 2B, the housing comprises three layers, internal housing layer A, middle layer B and external layer C. The space between layer A and B accommodates the connectivity apparatus. In order to remove air pockets that could destabilize the CAT system the space between layer A and B may be filled with injectable plastic material to remove air pockets. The space between layer B and C can be filled with injectable insulation to maintain standard temperature of pressure. In another preferred embodiment shown in FIG. 2C, the housing comprises a fourth layer D in addition to the three layers shown for the embodiment of FIG. 2B above. In the embodiment of FIG. 2C, the space between layer C and D can be filled with ballast material such as water or mud.

Figure 5:
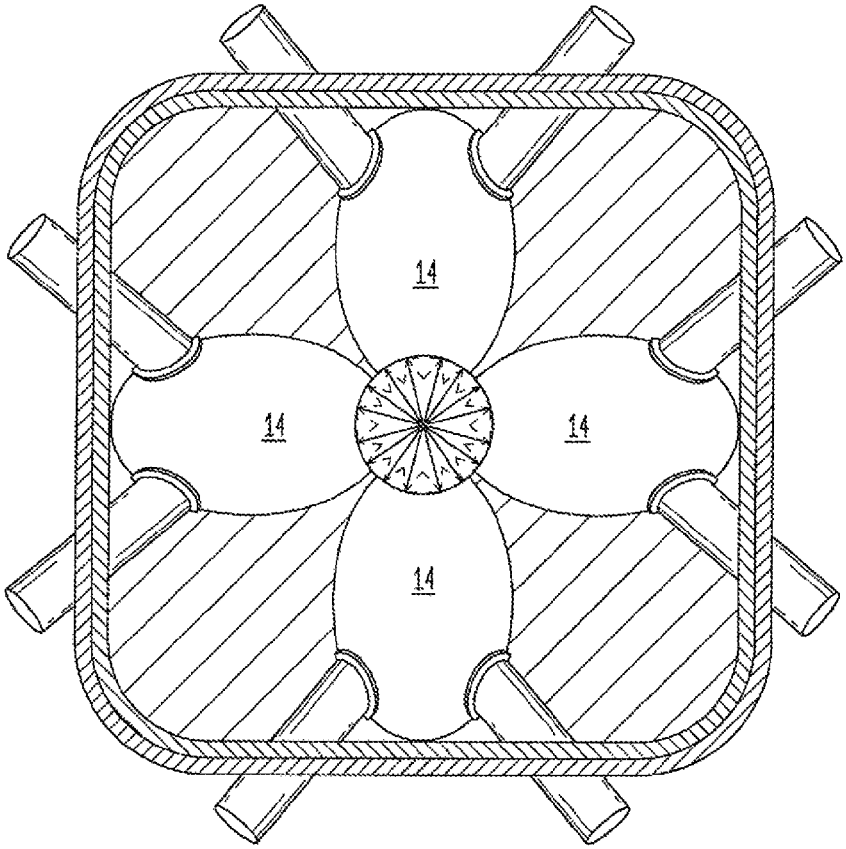
FIG. 5 is a horizontal section view of the system with quadruple aqueduct in accordance with one embodiment of the invention.
Figure 6:
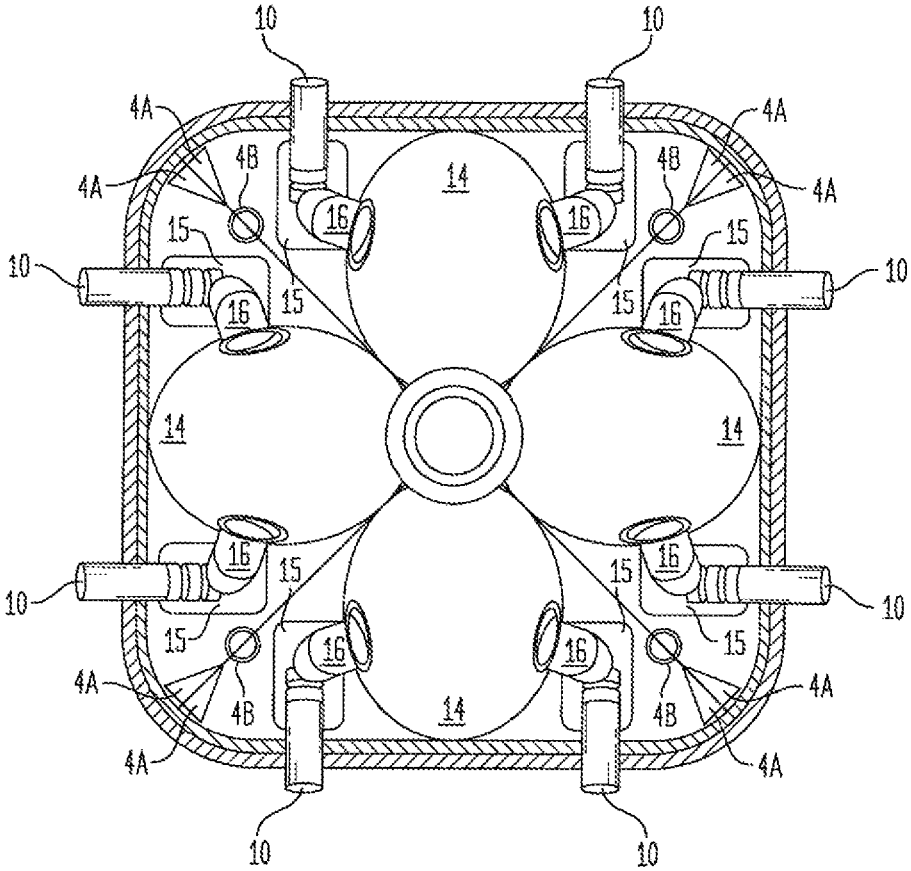
FIG. 6 is a horizontal section view of the system with quadruple aqueduct in accordance with one embodiment of the invention.
Figure 9:
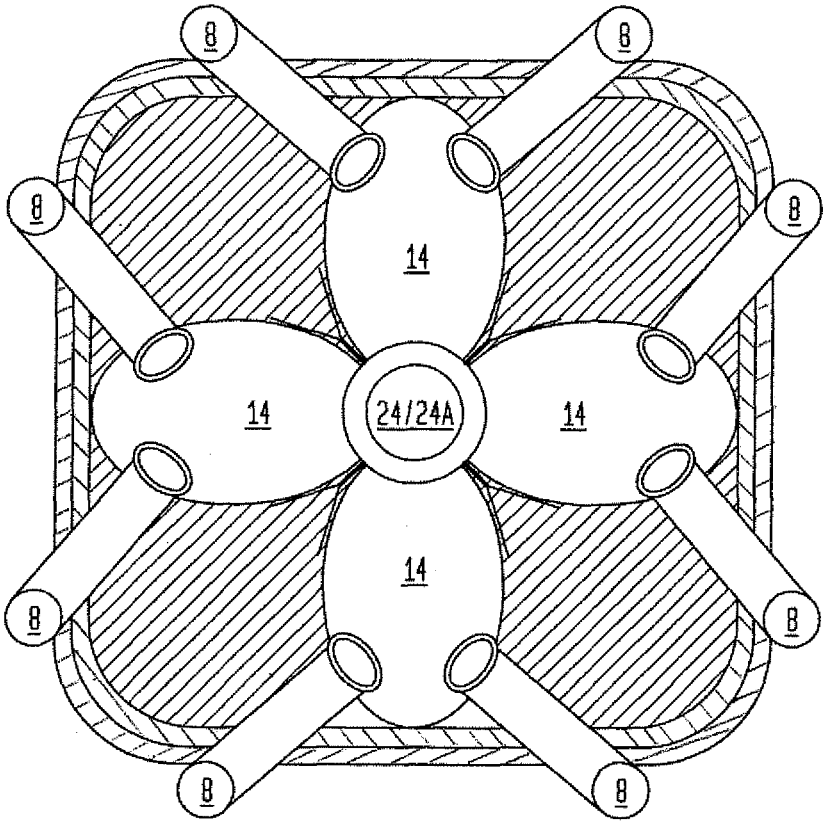
FIG. 9 is a horizontal section view of the system with quadruple aqueduct in accordance with one embodiment of the invention.

The number and shape of the receiving and distribution chamber(s) may vary. One preferred embodiment shown in FIG. 2 has a single chamber wherein the shape of the inner surface of the chamber resembles that of an open torus with the top and bottom opening of the torus forming the attachment points for the core pipe and the pipe threshold respectively. In another embodiment shown in FIG. 5 and FIG. 6 and FIG. 9, four receiving and distribution chambers may be present. In the embodiment shown in FIG. 5 and FIG. 6 and FIG. 9 the inner surface of each individual receiving and distribution chamber represents that of an ellipsoid. All four chambers are in fluid communication with each other and are sealably connected to the core pipe on their top and to the pipe threshold on their bottom.

In a particular embodiment the receiving and distribution chambers may also include sensor means for measuring the pressure and flow of gas or oil in the chamber. The sensor means may be any structure or device known in the art to measure the pressure of liquids or gas including but not limited to piezoresistive, capacitive, electromagnetic, piezoelectric, optical or potentiometric sensors.

Figure 3:
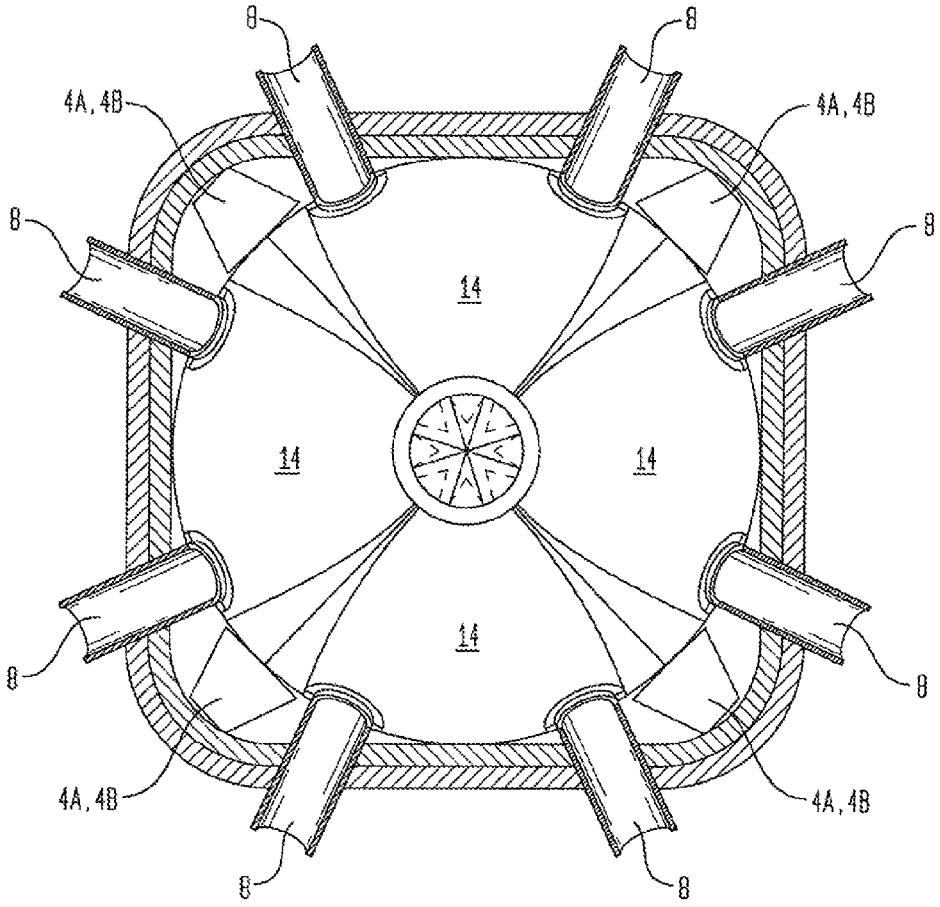
FIG. 3 is a horizontal section view of the system with volume channel arches in accordance with one embodiment of the invention.
Figure 4:
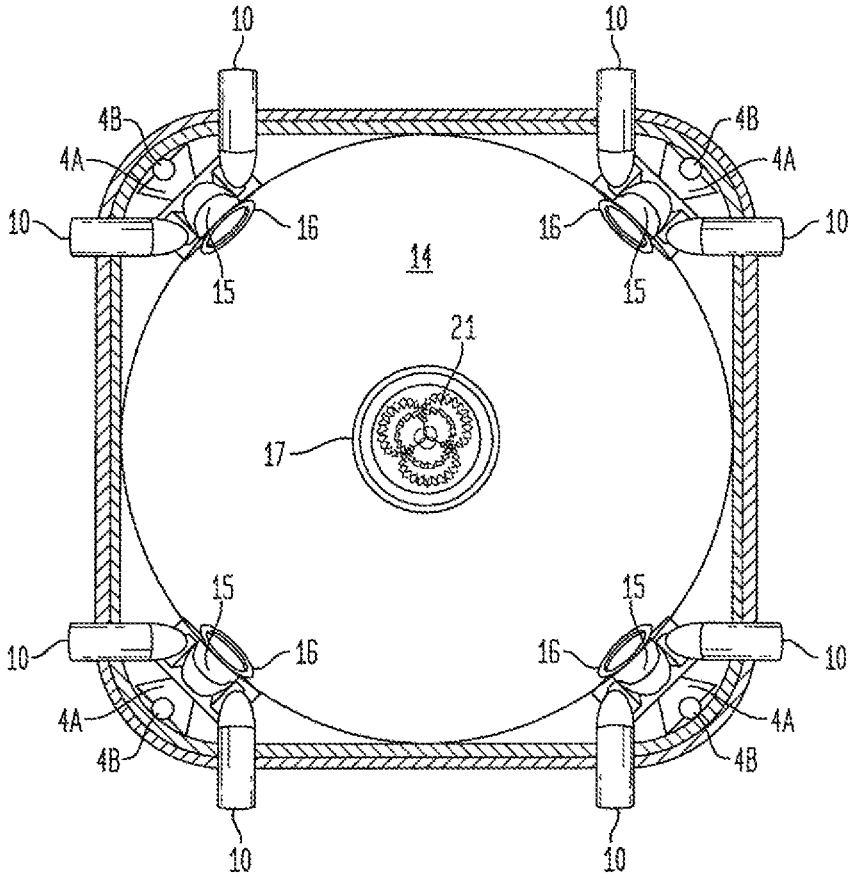
FIG. 4 is a horizontal section view of the system in accordance with one embodiment of the invention.

The number of output pipes and blowout relief vents may vary in different embodiments. An example of an embodiment with 8 output pipes and 8 blowout relief vents is shown in FIG. 3 and FIG. 4. FIG. 3 and FIG. 4 show that one advantageous way of arranging the output pipes and relief vents with regard to the receiving and distribution chamber is to use substantially even spacing between each output pipe and between each relief vent respectively. However, the spacing between each of the output pipes and between each of the relief vents does not have to be even.

The cone aperture may be any device or structure that is able to alternatively allow or prevent oil flow into the main aqueduct and which achieves the purpose of distributing incoming volume evenly when in a configuration to prevent oil flow into the main aqueduct. In one preferred embodiment the cone aperture comprises triangular members that are hingedly attached to the outside of the core pipe in such a way that when the edges of the triangular members are in contact with each other flow of oil or gas through the core pipe is prevented. In one embodiment the cone aperture may also include sensor means adapted to measure pressure and volume distribution of liquid or gas entering the receiving and distribution chamber. The sensor means may be any structure or device known in the art to measure the pressure of liquids or gas including but not limited to piezoresistive, capacitive, electromagnetic, piezoelectric, optical or potentiometric sensors. In yet another embodiment, parts of the members comprising the cone aperture may be magnetic such as to facilitate bringing the edges of the individual members in contact with each other.

While the invention has been illustrated and described as embodied in blow-out preventer and oil spill recovery management, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

Figure 7:
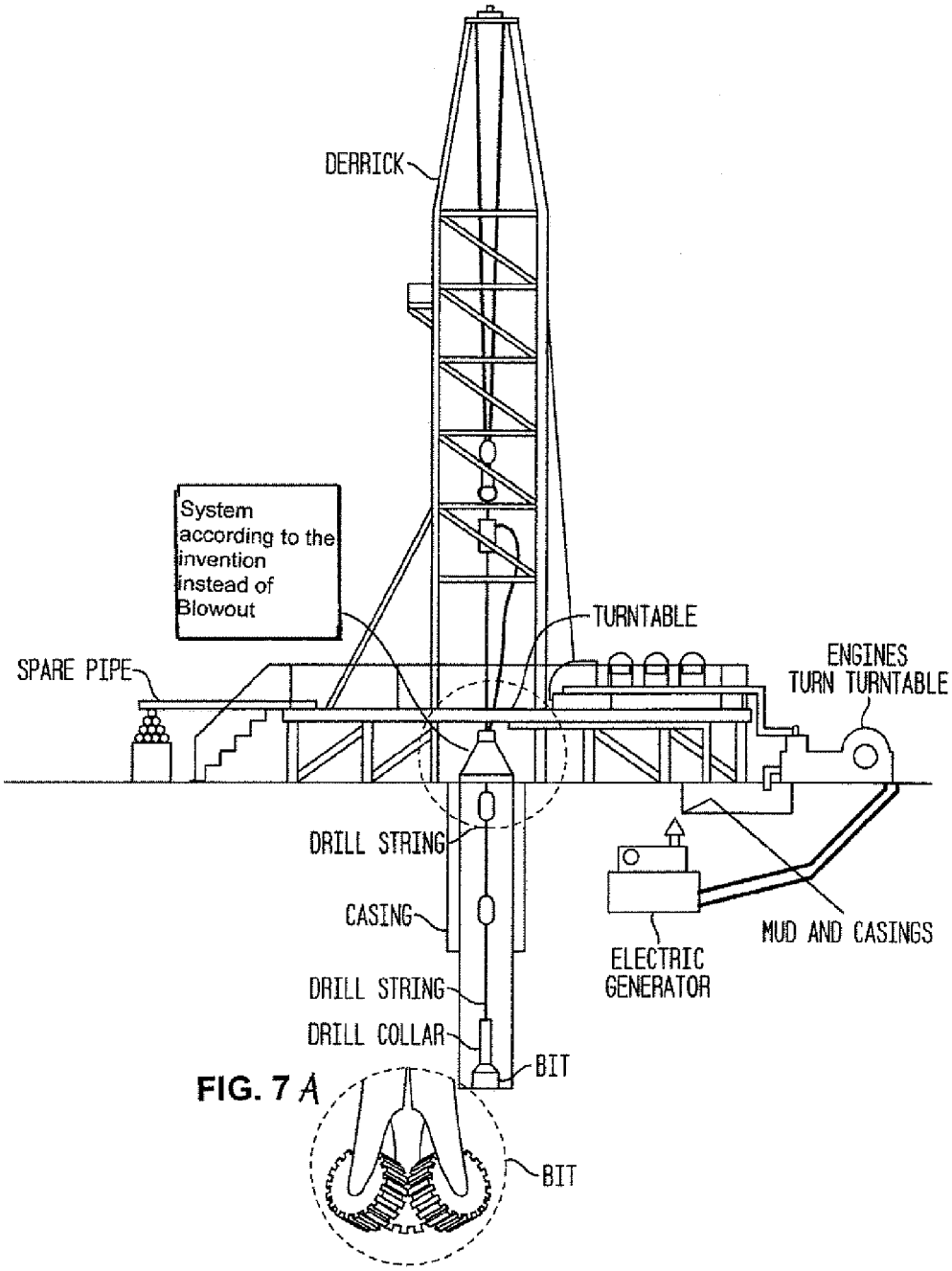
FIG. 7 is an elevational view of the system at an onshore drilling operation in accordance with one embodiment of the invention.

FIG. 7 shows an elevational view of the system according to the invention at an onshore drilling operation. FIG. 7 indicates where the system according to the invention would be employed instead of a conventional blowout preventer.

What is claimed is:

1. An apparatus for containing and controlling the flow of hydrocarbons from a bore well or other earth formation, comprising:

a housing;

a receiving and distribution chamber enclosed by the housing, said receiving and distribution chamber in fluid communication with and sealably connected to a top vertical tubular member and a bottom vertical tubular member, said top and bottom tubular members extending from said receiving and distribution chamber to the exterior of said housing, said top vertical tubular member having an inner tubular member comprising means for moving said inner tubular member along the axis of said top vertical tubular member, said inner tubular member adapted upon movement to sealably connect or disconnect, said bottom vertical tubular member to said top vertical tubular member, a cone aperture adapted to prevent or allow the flow of liquid into said top tubular member, at least one outlet passage between said receiving and distribution chamber and the exterior of said housing, valve means adapted to permit or prevent the flow of liquid through at least one of said outlet passages; and pump means adapted to facilitate the flow of hydrocarbons through at least one of said outlet passages.

2. The apparatus of claim 1 wherein said housing comprises at least two layers, said layers having a space in between them.

3. The apparatus of claim 2, further comprising:

means to measure fluid pressure in the receiving and distribution chamber, means to detect the presence of gas at the wellbore, and means to transmit information with regard to the presence of gas at the wellbore.

4. The apparatus of claim 3, further comprising anchoring means fixed to said housing to anchor the apparatus to the ground.

5. The apparatus of claim 4, further comprising a hose deployment set comprising a hose, an inflatable member, air supply means adapted to inflate said inflatable member, said inflatable member attached to said hose, and clamping means adapted to fix said hose to said receiving facility.

6. The apparatus of claim 5, wherein the number of outlet passages is sixteen, eight of said outlet passages having said valve means and eight of said outlet passages having said pump means.

7. The apparatus of claim 6, further comprising sensor means adapted to determine the position of the apparatus with regard to a wellbore or other target area, and propulsion means adapted to cause the device to change its position relative a wellbore or other target area.

8. The apparatus of claim 7 wherein the inner surface of said receiving and distribution chamber represents that of an open torus, wherein said top and bottom tubular members are sealably connected to the top and bottom opening of the open torus respectively.

9. The apparatus of claim 1, further comprising pressure sensor means means to detect the presence of gas, means adapted to transmit information with regard to the presence of gas, anchoring means fixed to said housing adapted to anchor the apparatus to the ground, a hose deployment set comprising a hose, an inflatable member, air supply means adapted to inflate said inflatable member, said inflatable member attached to said hose, and clamping means adapted to fix said hose to said receiving facility, sensor means adapted to determine the position of the apparatus with regard to a wellbore or other target area, and propulsion means adapted to cause the device to change its position relative a wellbore or other target area.

10. An apparatus for containing and controlling the flow of hydrocarbons from a well bore or other earth formation, comprising:

a housing;

four receiving and distribution chambers enclosed by the housing, said receiving and distribution chambers in fluid communication with each other and in fluid communication and sealably connected to a top vertical tubular member and a bottom vertical tubular member, said top and bottom tubular members extending from said receiving and distribution chambers to the exterior of said housing, said top tubular member having an inner tubular member comprising means for moving said inner tubular member along the axis of said top vertical tubular member, said inner tubular member adapted upon movement to sealably connect or disconnect, said bottom vertical tubular member to said top vertical tubular member, said inner tubular member adapted upon movement to sealably connect or disconnect, said bottom vertical tubular member to said top vertical tubular member, a cone aperture adapted to prevent or allow the flow of liquid into said top tubular member, at least one outlet passage between said receiving and distribution chamber and the exterior of said housing, valve means adapted to permit or prevent the flow of liquid through at least one of said outlet passages and, pump means adapted to facilitate the flow of hydrocarbons through at least one of said outlet passages.

11. The apparatus of claim 10 wherein said housing comprises at least two layers, said layers having a space in between them.

12. The apparatus of claim 11 further comprising means to measure fluid pressure in the receiving and distribution chamber, and means to detect the presence of gas at the wellbore and, means to transmit information with regard to the presence of gas at the wellbore.

13. The apparatus of claim 12 further comprising anchoring means fixed to said housing to anchor the apparatus to the ground.

14. The apparatus of claim 13 further comprising a hose deployment set comprising a hose, an inflatable member, air supply means adapted to inflate said inflatable member, said inflatable member attached to said hose, and clamping means adapted to fix said hose to said receiving facility.

15. The apparatus of claim 14 wherein the number of outlet passages is thirty two, sixteen of said outlet passages having said valve means and sixteen of said outlet passages having said pump means.

16. The apparatus of claim 15 further comprising sensor means adapted to determine the position of the apparatus with regard to a wellbore or other target area, and propulsion means adapted to cause the device to change its position relative a wellbore or other target area.

17. The apparatus of claim 16 wherein said cone aperture has sensor means adapted to measure parameters including pressure and liquid flow.

18. A method for containing and controlling the flow of hydrocarbons from a well bore or other earth formation using an apparatus comprising a housing comprising at least two layers, said layers having a space in between them, a receiving and distribution chamber enclosed by the housing, said receiving and distribution chamber in fluid communication with and sealably connected to a top vertical tubular member and a bottom vertical tubular member, said top and bottom tubular members extending from said receiving and distribution chamber to the exterior of said housing, said top tubular member having an inner tubular member comprising means for moving said inner tubular member along the axis of said top vertical tubular member, said inner tubular member adapted upon movement to sealably connect or disconnect, said bottom vertical tubular member to said top vertical tubular member, a cone aperture adapted to prevent or allow the flow of liquid into said top tubular member, at least one outlet passage between said receiving and distribution chamber and the exterior of said housing, valve means adapted to permit or prevent the flow of liquid through at least one of said outlet passages, and pump means adapted to facilitate the flow of hydrocarbons through at least one of said outlet passages the method comprising bringing said apparatus in contact with a well bore to allow hydrocarbons to enter said receiving and distribution chamber through said bottom vertical tubular member.

19. The method of claim 18 wherein the apparatus further comprises pressure sensor means, means for detecting the presence of gas, means adapted to transmit information with regard to the presence of gas, anchoring means fixed to said housing to anchor the apparatus to the ground, a hose deployment set comprising a hose, an inflatable member, air supply means adapted to inflate said inflatable member, said inflatable member attached to said hose, and clamping means adapted to fix said hose to said receiving facility, the method further comprising anchoring said apparatus to the ground, and activating the hose deployment set to deploy the hose.

20. A method for containing and controlling the flow of hydrocarbons from a well bore or other earth formation using an apparatus comprising a housing comprising at least two layers, said layers having a space in between them, a receiving and distribution chamber enclosed by the housing, said receiving and distribution chamber in fluid communication with and sealably connected to a top vertical tubular member and a bottom vertical tubular member, said top and bottom tubular members extending from said receiving and distribution chamber to the exterior of said housing, a cone aperture adapted to prevent or allow the flow of liquid into said top tubular member, at least one outlet passage between said receiving and distribution chamber and the exterior of said housing, valve means adapted to permit or prevent the flow of liquid through at least one of said outlet passages and, pump means adapted to facilitate the flow of hydrocarbons through at least one of said outlet passages, pressure sensor means, means for detecting the presence of gas, means adapted to transmit information with regard to the presence of gas, anchoring means fixed to said housing adapted to anchor the apparatus to the ground, a hose deployment set comprising a hose, an inflatable member, air supply means adapted to inflate said inflatable member, said inflatable member attached to said hose, and clamping means adapted to fix said hose to said receiving facility a core pipe and a pipe threshold; and sensor means adapted to determine the position of the apparatus with regard to a wellbore or other target area, the method comprising positioning said apparatus over an area of interest, and inserting a tubular member adapted to accommodate drilling means into the core pipe and the pipe threshold of the apparatus.

* * * * *